US007247415B2

(12) United States Patent
Mang et al.

(10) Patent No.: US 7,247,415 B2
(45) Date of Patent: Jul. 24, 2007

(54) PROCESS FOR PREPARING TONER PARTICLES AND TONER PARTICLES

(75) Inventors: Mark E. Mang, Rochester, NY (US); Joseph L. Leonardo, Penfield, NY (US); Hui Chang, Pittsford, NY (US); Robert R. Heim, Webster, NY (US)

(73) Assignee: Xerox Corporation, Stamford, CT (US)

( * ) Notice: Subject to any disclaimer, the term of this patent is extended or adjusted under 35 U.S.C. 154(b) by 465 days.

(21) Appl. No.: 10/929,547

(22) Filed: Aug. 31, 2004

(65) Prior Publication Data

US 2006/0046179 A1 Mar. 2, 2006

(51) Int. Cl.
*G03G 9/08* (2006.01)

(52) U.S. Cl. ..... 430/137.19; 430/137.18

(58) Field of Classification Search ..... 430/137.18, 430/137.19

See application file for complete search history.

(56) References Cited

U.S. PATENT DOCUMENTS

| | | | | |
|---|---|---|---|---|
| 3,590,000 | A | | 6/1971 | Palermiti et al. |
| 3,655,374 | A | | 4/1972 | Palermiti et al. |
| 3,720,617 | A | | 3/1973 | Chatterji et al. |
| 3,944,493 | A | | 3/1976 | Jadwin et al. |
| 3,983,045 | A | | 9/1976 | Jugle et al. |
| 4,007,293 | A | | 2/1977 | Mincer et al. |
| 4,079,014 | A | | 3/1978 | Burness et al. |
| 4,394,430 | A | | 7/1983 | Jadwin et al. |
| 4,560,635 | A | | 12/1985 | Hoffend et al. |
| 4,935,326 | A | | 6/1990 | Creatura |
| 4,937,166 | A | | 6/1990 | Creatura |
| 4,973,439 | A | * | 11/1990 | Chang et al. ..... 264/101 |
| 5,145,762 | A | * | 9/1992 | Grushkin ..... 430/137.21 |
| 5,593,807 | A | | 1/1997 | Sacripante et al. |
| 5,945,245 | A | | 8/1999 | Mychajlowskij et al. |
| 6,197,883 | B1 | | 3/2001 | Schimmel et al. |
| 6,218,483 | B1 | | 4/2001 | Muthiah |
| 6,228,941 | B1 | | 5/2001 | De Cock et al. |

FOREIGN PATENT DOCUMENTS

| | | |
|---|---|---|
| DE | 198 04 281 A1 | 8/1999 |
| EP | 1 055 694 A2 | 11/2000 |
| EP | 1 111 012 A1 | 6/2001 |
| GB | 1442835 | 7/1976 |
| JP | 2000-160061 | 6/2000 |
| JP | 2001-123110 | 5/2001 |
| WO | WO 94/10221 | 5/1994 |
| WO | WO 94/11446 | 5/1994 |

* cited by examiner

*Primary Examiner*—Christopher Rodee
(74) *Attorney, Agent, or Firm*—Oliff & Berridge, PLC

(57) ABSTRACT

Toner particles are prepared by a process comprising providing an extrusion apparatus; adding resin particles and additive particles to a supply means in the extrusion apparatus; adding the resin particles and the additive particles to a blending chamber in the extrusion apparatus, which blending chamber is maintained at a temperature of from about 50° C. to about 120° C.; blending the resin particles and the additive particles to form a mixture; extruding the resin particles to form extruded material; injecting liquid substances, which have a lower boiling point than the melt temperature of the resin particles, into the blending chamber during extrusion without the application of a vacuum to remove the liquid substances prior to extrusion; and grinding the extruded material to form toner particles.

7 Claims, 1 Drawing Sheet

PROCESS FOR PREPARING TONER PARTICLES AND TONER PARTICLES

BACKGROUND OF THE INVENTION

1. Field of Invention

This invention relates to a process for forming toner particles, toner particles prepared by the process, and developer compositions including the toner particles prepared by the process. More specifically, this invention relates to an extrusion process for the preparation of toner compositions.

2. Description of Related Art

In the process of electrophotographic printing, a photoreceptor containing a photoconductive insulating layer on a conductive layer is imaged by uniformly electrostatically charging the surface. The photoreceptor is then exposed to a pattern of activating electromagnetic radiation, such as light. The radiation selectively dissipates the charge in the illuminated areas of the photoconductive insulating layer, while an electrostatic latent image is formed on the non-illuminated areas. Toner particles are attracted from carrier granules to the latent image to develop the latent image. The toner image is then transferred from the photoconductive surface to a sheet and fused onto the sheet.

Various toner compositions for such a printing system are well known in the art and have been produced having a wide array of additives and constituent materials. Generally, toner particles include a binding material, such as a resin, and any of various additives to provide particular properties to the toner particles.

Numerous devices and processes are known for preparing toner particles. Examples of commercially known processes include the melt-blending of toner components in a Banbury roll mill apparatus, spray drying, dispersion polymerization, solution polymerization, and the like. It is well known that toner compositions can be obtained with an extrusion apparatus. An extrusion apparatus and process enables a number of advantages that cannot be achieved with a Banbury roll mill apparatus and process. For example, extrusion is a continuous process, rather than a batch process, and extrusion processes can be easily automated, allowing for more economical toner preparation.

Certain additives useful in toner particles are partially or totally immiscible in the resin materials with which they may be used. Although this immiscibility is advantageous for some additives, such as waxes, which must remain in a distinct phase in order to properly function, the toner itself must be relatively homogeneous to function properly. Thus, it is necessary to disperse the immiscible components in the blending process. Two known methods for homogenously dispersing additives are the use of a compatibilizer and the injection of a liquid into the blending chamber during the extrusion process.

The use of a compatibilizer to disperse additive particles, in particular wax particles, has drawbacks for toner production. For example, it is known that the grinding rate of the extruded material is reduced by compatibilizers that have been incorporated into the resin materials to disperse additives. The reduction of the grinding rate increases the time that the composition must remain in residence in the grinder and often results in the grinding step limiting the overall production rate. This increased residence time increases the total production time and costs, and decreases the efficiency of the production process.

Water or liquid injection, which lowers the melting temperature to disperse additive particles in toner resin compositions, is an alternative to the use of a compatibilizer. The bulk of the injected liquid, along with any volatile materials, is removed by the application of a vacuum prior to the discharge of the toner formulation from the toner processing apparatus. However, vacuum equipment is difficult and expensive to operate and maintain.

U.S. Pat. No. 4,973,439, which is incorporated herein in its entirety, discloses a toner processing apparatus for obtaining toner particles with improved dispersion of additive components, comprising a blending chamber, a mixing screw, a heater, a supply means, an injector for injecting liquids enabling a decrease in the melting temperature of the resin particles, and a vacuum extractor for removing the injected liquid prior to extrusion.

There remains a need for an alternative to the above methods for dispersing additives throughout the resin in toner particles. In particular, there is a need for a method of dispersing additives without reducing the grinding rate, as occurs with the use of compatiblilizers, and without the need for expensive vacuum equipment.

SUMMARY OF THE INVENTION

The present invention is directed to the preparation of toner particles by a process, which includes injection of a liquid substance into the toner processing apparatus during extrusion, without removal of the liquid prior to extrusion. Although the present invention is particularly directed to the use of particles for toner compositions, such as in electrophotographic printing, it may be possible to use the process for preparing toner particles, and the toner particles, according to the present invention for other purposes.

In embodiments, the present invention is directed to a process for preparing toner particles. The process comprises providing a toner processing apparatus, adding resin particles and additive particles to a supply means in the toner processing apparatus, adding the resin particles and the additive particles to a blending chamber in the toner processing apparatus, which blending chamber is maintained at a temperature of from about 50° C. to about 230° C., blending the resin particles and the additive particles to form a mixture, extruding the resin particles to form extruded material; and grinding the extruded material to form toner particles. During extrusion, liquid substances are injected into the blending chamber. These liquid substances, which have a lower boiling point than the melt temperature of the resin particles, are not removed from the blending chamber by vacuum extraction.

In embodiments, the resin particles may comprise thermoplastic resins, thermoset resins and curable resins. In particular embodiments, the resin particles may be chosen from polyesters, styrene-n-butyl methacrylate copolymers, styrene butadiene copolymers and mixtures thereof.

In embodiments, the additive particles added to the supply means may comprise colorants, magnetites, charge-enhancing additives, flow-control agents, plasticizers, stabilizers, antioxidants, waxes, fillers, curing agents, UV absorbing agents, light stabilizers, and mixtures thereof. Other additive particles such as may be contemplated by one of skill in the art may also be added to the supply means.

In embodiments, the additive particles comprise wax particles, such as polyolefins, paraffins, esters and natural waxes like carnauba.

In embodiments, the liquid substances may comprise water, aliphatic alcohols, solutions including additives, and suspensions including additives. The additives included in the liquid substances, either in solution or in suspension, include but are not limited to colorants, magnetites, charge-enhancing additives, flow-control agents, plasticizers, stabilizers, antioxidants, waxes, fillers, curing agents, UV absorbing agents, light stabilizers, and mixtures thereof.

In embodiments, the present invention is also directed to toner particles prepared by a process comprising providing a toner processing apparatus, adding resin particles and additive particles to a supply means in the toner processing apparatus, adding the resin particles and the additive particles to a blending chamber in the toner processing apparatus, which blending chamber is maintained at a temperature of from about 50° C. to about 230° C., blending the resin particles and the additive particles to form a mixture, extruding the resin particles to form extruded material; and grinding the extruded material to form toner particles. During extrusion, liquid substances are injected into the blending chamber. These liquid substances have a lower boiling point than the melt temperature of the resin particles and are not removed from the blending chamber by vacuum extraction.

In embodiments, the toner particles may be combined with surface additives and/or carrier particles. In embodiments, the toner particles may be combined with dry-blended additives.

In embodiments, the present invention also provides developer compositions including such toner particles according to embodiments of the invention and carrier particles.

In embodiments, the present invention also provides an imaging method that comprises forming an electrostatic latent image on a photoreceptor, developing the electrostatic latent image with the toner composition according to embodiments of the invention, and transferring the developed image to a suitable substrate.

In embodiments, the present invention additionally provides an imaging apparatus that comprises a charging component, a photoreceptor component, a developer component, and a transfer component, wherein said developer component includes the toner composition that has been prepared according to embodiments of the invention.

DETAILED DESCRIPTION OF PREFERRED EMBODIMENTS

Figure 1:
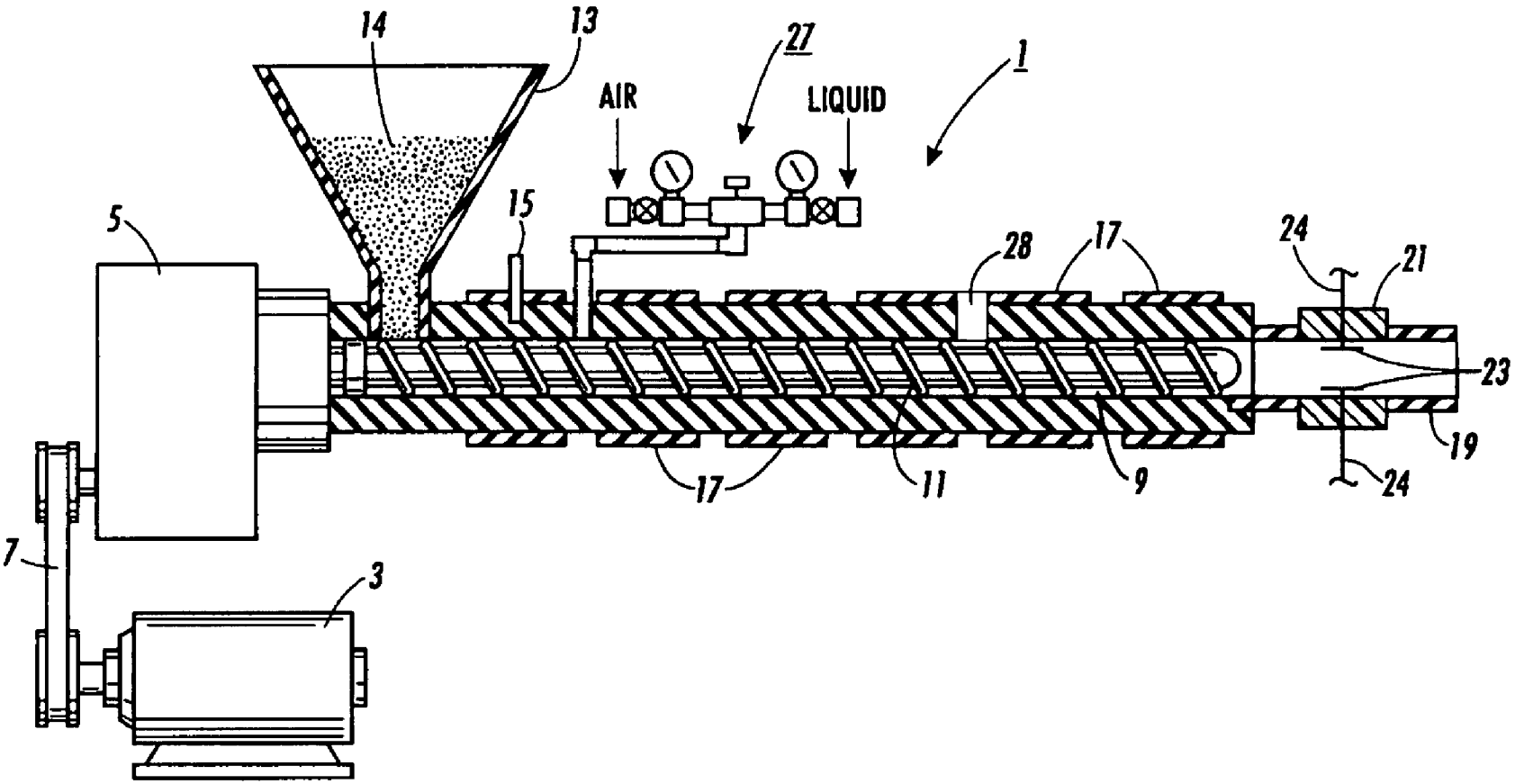
FIG. 1 is a schematic cross-sectional view of a toner extrusion apparatus according to embodiments of the invention.

The present invention is generally directed to toner particles, and a process for preparing such toner particles, using a toner processing apparatus. Examples of toner processing apparatus include continuous compounding devices, such as single screw extruders, and twin screw extruders, continuous mixers, transfer mixers, co-kneaders, and the like, with extrusion apparatuses being preferred.

A process for preparing toner particles in accordance with embodiments of the invention is explained herein with reference to exemplary FIG. 1. Illustrated in FIG. 1 is an example of a toner processing apparatus that may be used in accordance with the invention. This apparatus is a twin screw extrusion device 1, containing a drive motor means 3, a gear reducer means 5, a belt means 7, a blending chamber 9, a screw means 11, a supply means or hopper 13, with toner resin particles, and pigment particles 14 therein, a thermocouple means 15, a heating means 17, a die or head pressure means 19, an optional sensing head 21, electrodes 23, and lead wires 24, which are connected to a capacitance or conductance type bridge, and an injection means 27.

In order to prepare toner particles, resin particles and additive particles are added to the supply means or hopper 13 of the toner processing apparatus. These particles may be pre-blended. That is, the resin particles and additive particles may be mixed prior to their introduction into the toner processing apparatus. The resin particles and additive particles are added to the blending chamber 9. These components are blended and thoroughly mixed in chamber 9 by rotation of screw 11 to form an extrudate containing the dispersed additives. This blending can be accomplished at elevated temperatures controlled by heating means 17.

The speed of the screw 11 can be of any suitable value to melt-blend the resin and additive particles. In embodiments, the speed of screw 11 is from about 100 revolutions per minute to about 500 revolutions per minute. The temperature in the blending chamber 9 can vary; however, in embodiments, this temperature, which is controlled by a thermocouple 15 and generated by heating means 17, is from about 50° C. to about 230° C. In embodiments, one or more venting means 28 may be provided between the blending chamber 9 and the exterior of the toner processing apparatus to allow excess pressure in the blending chamber 9 to be released; the location or locations of venting means 28 along the blending chamber 9 is not particularly limited. The die or head pressure means 19 generates pressure of from about 10 pounds per square inch to about 1,500 pounds per square inch. In embodiments, the screw is allowed to rotate at 200 revolutions per minute to about 500 revolutions per minute, and the die or head pressure can vary from 10 pounds per square inch to 1,500 pounds per square inch.

Parameters associated with the blending chamber, including the amount of polymer resin particles and additive particles introduced therein can be controlled by means of a computer that receives information from a microprocessor on a continuous basis. The microprocessor is operatively connected to a capacitance, conductance bridge which transmits information to the microprocessor based on data generated from the sensing head 21 connected to the bridge by wires 24. Alternatively, a toner processing device, such as the toner processing apparatus shown in FIG. 1, need not contain a sensing means therein, nor a computer arrangement, rather the process parameters can be adjusted, if appropriate, by sampling the toner composition product obtained subsequent to processing, as is common with the Banbury roll mill mixing apparatus, for example.

After a suitable mixing period, the extrudate passes through the blending chamber 9 to a die or head pressure means 19 located at an outlet of the toner processing apparatus. The die or head pressure means 19 includes an aperture through which the extrudate exits the toner processing apparatus. The size of the aperture is selected to provide suitable flow for a commercially acceptable process.

During extrusion processing, liquid substances are introduced into the melted toner formulation, by injection means 27. The introduction of the liquid substances, which may optionally include additional additives, enables a reduction of the melt temperature of the toner composition, which causes an increase in the viscosity of the toner composition and the desirable dispersion of additive particles.

The injection means 27, which is operatively connected to the toner processing apparatus as illustrated, enables the efficient controlled introduction of various additives into the toner formulation. These additives can be injected in the form of a solution or a suspension. The addition of a liquid substance, which may be a solvent or suspension medium, enables the melt temperature of the resin to be desirably lowered. This lowering of the melting temperature enables a more effective dispersion of the pigment particles present in the toner formulation, and increased dispersion of the charge-enhancing additives. The lower melting temperature is caused by evaporation of the liquid substances injected into the extrusion device, these liquid substances having a lower boiling point than the melting temperature of the resin. In this manner, upon evaporation, heat is extracted from the toner melt causing the temperature to be significantly decreased.

While it is not desired to be limited by theory, it is believed that a decrease in the melt temperature of the toner composition causes the viscosity of the polymer component to increase significantly, resulting in higher shear, and thus enabling more effective dispersion of the additive particles. More specifically, the shear forces cause pulverization of the additive particles, for example, to submicron sizes, less than 3 microns enabling better dispersion thereof.

The injection means 27 can be situated at various locations in the toner processing apparatus. Generally, the injection means 27 is located at a position that will allow sufficient time for the toner polymer to achieve melting. In embodiments, the nozzle of the injection means 27 is located at a distance on the toner processing apparatus of from about 6 times the diameter to about 8 times the diameter of the screw means 11. Moreover, there can be selected a multiple number of injection means 27, thus more than one nozzle can be located in the toner processing apparatus, and suitably effectively spaced from the first nozzle.

It is not necessary to remove the liquid substance prior to extraction. Rather, the liquid substance is removed by evaporation during extrusion. That is, as the extrudate exits the toner processing apparatus through the die plate, the liquid substances, which have a boiling point below the melt temperature of the resin, evaporate out of the extrudate. While it is not desired to be limited by theory, it is believed that the evaporation of the liquid substances as the extrudate exits the toner processing apparatus creates voids and fractures in the extruded material. These voids and fractures are believed to increase the grinding rate of the extruded material. As a result, there is obtained toner particles with controlled admix characteristics, stable triboelectric charging values and good charge distribution characteristics.

The extrudate from the toner processing apparatus can be cooled and, for example, pelletized. After the extrudate has been cooled and pelletized, the pellets may be crushed to form toner particles, and the toner particles may be reduced in size by any suitable method, including those known in the art or later developed. An important property of toners is brittleness, which causes the resin to fracture when impacted. This allows rapid particle size reduction in aerators, other media mills, or even jet mills to make dry toner particles. It should be appreciated that the particle size reduction may possibly include the use of a pulverizer (not shown). The pulverizer may be a hammer mill such as, for example, an ALPINE hammer mill or FITZMILL rotary mill. The hammer reduces the toner particles to a size of about 300 microns to about 3 mm.

A micronization system may be connected to the toner processing apparatus to form a toner manufacturing system. The micronization system serves to reduce the particle size of milled particles or material into toner particles of an appropriate size, such as four to ten microns.

Toner particles that may be produced by the above-described method generally comprise a solid film-forming resin and optionally one or more additives, such as colorants, magnetites, fillers, flocculants, curing agents, leveling agents, charge additives, flow-promoting agents, flow-control agents, plasticizers, stabilizers, anti-gassing agents, antioxidants, UV absorbing agents, light stabilizers and waxes.

In embodiments, the resin is selected from the group consisting of thermoset resins, curable resins and thermoplastic resins. Thermoplastic coating polymers include, but are not limited to, polyamides, polyolefins, plasticized PVC, polyester and poly (vinylidene fluoride), ionomers, styrenes, copolymers comprising styrene and an acrylic ester, and the like. Materials utilized in thermoset powder coatings include epoxy resins, polyester resins and acrylic resins. Non-limiting examples of suitable curable resins include epoxy resins, poly-functional epoxy resins, polyester resins, carboxy-functional polyester resins, hydroxy-functional polyester resins, polyol resins, polycarboxylic acid resins and poly (vinylidene fluoride) resins. Specifically, the resin selected is at least one resin chosen from the group comprising epoxy resins, polyester resins, carboxy-functional polyester resins, hydroxy-functional polyester resins, acrylic resins, functional acrylic resins, polyamide resins, polyolefin resins, plasticized PVC, polyester and poly (vinylidene fluoride), and ionomers, and mixtures thereof.

In embodiments, any suitable thermoplastic resin, or combination of thermoplastic resins, can be used. Illustrative examples of such suitable resins include, for example, thermoplastic resins such as vinyl resins in general or styrene resins in particular, and polyesters. Examples of suitable thermoplastic resins include, but are not limited to, styrene methacrylate; polyolefins; styrene acrylates, such as PSB-2700 (obtained from Hercules-Sanyo Inc.); polyesters; styrene butadienes; crosslinked styrene polymers; epoxies; polyurethanes; vinyl resins, including homopolymers or copolymers of two or more vinyl monomers; and polymeric esterification products of a dicarboxylic acid and a diol comprising a diphenol. Other suitable vinyl monomers include, but are not limited to, styrene; p-chlorostyrene; unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, and acrylamide; mixtures thereof; and the like. In addition, crosslinked resins, including polymers, copolymers, and homopolymers of styrene polymers, may be selected. As used herein, the term "styrene" refers to styrene per se, as well as styrene containing modifications, such as a-methyl styrene, 3-chlorostyrene, 2,5-dichlorostyrene, 4-bromostyrene, 4-tert-butylstyrene, 4-methoxystyrene, vinyl naphthalene, vinyl toluene, and divinyl benzene.

Copolymers in embodiments may also comprise a small amount of one or more additional monomers. In embodiments, the copolymer contains at least 90 weight percent of styrene or acrylic or methacrylic monomers according to the present invention. The copolymer may also contain up to 10 weight percent of other monomers. Suitable monomers include, but are not limited to, vinyl esters of aliphatic acids, ethylenically unsaturated carboxylic acids and known crosslinking agents. Suitable ethylenically unsaturated carboxylic acids include, but are not limited to, itaconic acid, maleic acid, fumaric acid, 2-carboxyethyl acrylate (β-CEA), and the like.

Toner particles formed from any of the above resins or combinations of resins, in embodiments, may or may not be cross-linked. Any suitable cross-linking agent may be used. Suitable cross-linking agents include, but are not limited to, amines, anhydrides, isocyanates, divinyl benzene, divinyl toluene, diacrylates, dimethacrylates, and the like.

In embodiments, toner particles are prepared using suitable thermoset polymer resins. In embodiments, suitable thermoset toner compositions are adapted from known powder-coating systems such as, for example, carboxyl-terminated branched polyesters in combination with multifunctional epoxy resins, such as those described in U.S. Pat. No. 6,228,941; carboxyl-functionalized acrylic resins compounded with multifunctional epoxy resins, such as those described in Japanese patent application publication JP 2001-123110; epoxy resins or epoxy-functionalized acrylic resins in combination with latent polyfunctional amine catalysts, such as those described in U.S. Pat. No. 6,197,883 and European Patent EP 1 055 694 A2; blocked isocyanates in combination with hydroxyl-functionalized polyesters or acrylics, such as those described in WO 94/10221, Japanese patent application publication JP 2000-160061 and German Patent DE 198 04 281 A1; epoxy functionalized resins in combination with polycarboxylic acid cross-linking agents, such as those described in U.S. Pat. No. 6,218,483; macrocyclic esters, carbonates, amides or imides, ring-opened and polymerized in the present of polyfunctional epoxy resins, such as those described in European Patent EP 1 111 012 A1; mixtures thereof, and the like. The entire disclosures of the above-cited references are incorporated herein by reference.

In embodiments, thermally cross-linkable resins such as carboxyl- and hydroxyl-functionalized polyester and acrylic resins, epoxy resins and epoxy-functionalized acrylic resins, blocked isocyanates, hydroxyl-functionalized polyesters or acrylics, polycarboxylic acid cross-linking agents, macrocyclic esters, carbonates, amides or imides and polyfunctional epoxy resins, which can be obtained commercially, are used. In embodiments, commercially available polyfunctional amine catalysts are used.

The composition may, for example, be based on a solid polymeric binder system comprising a carboxy-functional polyester film-forming resin used with a polyepoxide curing agent. Such carboxy-functional polyester systems are currently the most widely used. The polyester generally has an acid value in the range 10-100, a number average molecular weight Mn of 1,500 to 10,000 and a glass transition temperature Tg of from 30° C. to 85° C., preferably at least 40° C. The polyepoxide can, for example, be a low molecular weight epoxy compound such as triglycidyl isocyanurate (TGIC), a compound such as diglycidyl terephthalate or diglycidyl isophthalate, an epoxy resin such as a condensed glycidyl ether of bisphenol A or a light-stable epoxy resin. Such a carboxy-functional polyester film-forming resin can alternatively be used with a bis-(beta-hydroxyalkylamide) curing agent such as tetrakis(2-hydroxyethyl)adipamide.

In embodiments, the resin is a polyester, most preferably a sulfonated polyester, which may be formed from any suitable acid and alcohol. Preferably, the polyester is derived from one or more terephthalates and one or more glycols. For example, the polyester may be derived from a reaction that includes, for example, three glycol components. In embodiments, the polyester is a sulfonated polyester derived from a reaction of dimethylterephthalate, sodium dimethyl 5-sulfoisophthalate, propanediol, diethylene glycol and dipropylene glycol. Additional examples of sulfonated polyesters which may be used in the present invention include those illustrated in U.S. Pat. Nos. 5,593,807 and 5,945,245, the disclosures of which are totally incorporated herein by reference.

As a further possibility, an epoxy resin can be used with an amine-functional curing agent such as, for example, dicyandiamide. Instead of an amine-functional curing agent for an epoxy resin, a phenolic material may be used, preferably a material formed by reaction of epichlorohydrin with an excess of bisphenol A (that is to say, a polyphenol made by adducting bisphenol A and an epoxy resin). A functional acrylic resin, for example a carboxy-, hydroxy- or epoxy-functional resin can be used with an appropriate curing agent. Mixtures of resins can be used, for example a carboxy-functional polyester can be used with a carboxy-functional acrylic resin and a curing agent such as a bis-(beta-hydroxyalkylamide) which serves to cure both polymers. As further possibilities, for mixed resin systems, a carboxy-, hydroxy- or epoxy-functional acrylic resin may be used with an epoxy resin or a polyester resin (carboxy- or hydroxy-functional). Such resin combinations may be selected so as to be co-curing, for example, a carboxy-functional acrylic resin co-cured with an epoxy resin, or a carboxy-functional polyester co-cured with a glycidyl-functional acrylic resin. More usually, however, such mixed resin systems are formulated so as to be cured with a single curing agent (for example, use of a blocked isocyanate to cure a hydroxy-functional acrylic resin and a hydroxy-functional polyester). Another formulation involves the use of a different curing agent for each resin in a mixture of two or more polymeric resins (for example, an amine-cured epoxy resin used in conjunction with a blocked isocyanate-cured hydroxy-functional acrylic resin).

Other film-forming thermoset polymers which may be mentioned include functional fluoropolymers, functional fluorochloropolymers and functional fluoroacrylic polymers, each of which may be hydroxy-functional or carboxy-functional, and may be used as the sole film-forming polymer or in conjunction with one or more functional acrylic, polyester and/or epoxy resins.

In embodiments, additives are combined with the resin particles prior to their introduction into the blending chamber. Additives may be added, in embodiments, for any of various reasons, including, but not limited to, providing color, improving charging characteristics and improving flow properties. For example, additives including, but not limited to, colorants; magnetites; fillers, such as calcium sulfate or barium sulfate; flocculates; curing agents; leveling agents, such as silicone; charge additives; flow-promoting agents, such as silicas; flow-control agents; plasticizers; stabilizers, such as stabilizers against UV degradation; anti-gassing and degassing agents, such as benzoin, surface additives; antioxidants; UV absorbers; light stabilizers and waxes may be included. In embodiments where high gloss is desired, toner particles can be formulated free of pigment.

Colorants incorporated in embodiments include pigments, dyes, and mixtures of pigments with dyes, and the like. For example, various known cyan, magenta, yellow, red, green, brown, or blue colorants, or mixtures thereof are incorporated into toner compositions in accordance with embodiments of the invention. In embodiments, cyan, magenta, or yellow pigments or dyes, or mixtures thereof, are used. Any known or later developed colorant may be used in accordance with the invention.

Illustrative examples of colorants, such as pigments, that may be used in the processes of embodiments of the invention include, but are not limited to, carbon black, such as REGAL 330®; magnetites, such as Mobay magnetites M08029™, MO8060™; Columbian magnetites; MAPICO BLACKS™ and surface treated magnetites; Pfizer magnetites CB4799™, CB5300™, CB5600™, MCX6369™;

Bayer magnetites, BAYFERROX 8600™, 8610™; Northern Pigments magnetites, NP-604™, NP-608™; Magnox magnetites TMB-100™, or TMB-104™; and the like. Colored pigments or dyes, including cyan, magenta, yellow, red, green, brown, blue and/or mixtures thereof, may also be used.

In embodiments, a colorant may be included in known amounts, to achieve a desired color strength. For example, in embodiments, at least one of dyes and/or pigments and/or other colorants, is included in a toner composition in a suitable amount. In embodiments, at least one of dyes and/or pigments and/or other colorants, is included in an amount from about 1 to about 20 percent by weight of the toner composition. In some embodiments, the colorant is included in an amount of from about 2 to about 10 percent by weight of the toner composition.

In embodiments, magnetites are included, either for their magnetic properties, or for the colorant properties as discussed above, or both. Magnetites that are used in toner compositions of some embodiments of the present invention include, but are not limited to, a mixture of iron oxides ($FeO\square Fe_2O_3$), including those commercially available as Mobay magnetites M08029™, MO8060™; Columbian magnetites; MAPICO BLACKS™ and surface-treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. In embodiments, a magnetite is present in a toner composition in an effective amount. In embodiments, the magnetite is present in an amount of from about 10 percent by weight to about 75 percent by weight of the toner composition. In embodiments, the magnetite is present in an amount of from about 10 percent to about 55 percent by weight of the toner composition.

Curing agents that may be mentioned for use in accordance with embodiments of the invention include epoxy phenol novolacs and epoxy cresol novolacs; isocyanate curing agents blocked with oximes, such as isopherone diisocyanate blocked with methyl ethyl ketoxime, tetramethylene xylene diisocyanate blocked with acetone oxime, and DESMODUR W (dicyclohexylmethane diisocyanate curing agent) blocked with methyl ethyl ketoxime; light-stable epoxy resins such as SANTOLINK LSE 120 (supplied by Monsanto); alicyclic poly-epoxides such as EHPE-3150 (supplied by Daicel); polyfunctional amines; dicyanodiamide; bisphenol A; bisphenol S; hydrogenated bisphenol; polyphenolics; imidazoles, such as 2-methyl imidazole and 2-phenyl imidazole; betahydroxy-alkylamide; uretdione; and polyfunctional isocyanates, such as 2,4-toluene diisocyanate, 2,6-toluene diisocyanate, alkaline diisocyanates, xylene-diisocyanate, isophorone-diisocyanate, methylene-bis(4-phenyl isocyanate),methylene-bis-(4-cyclohexyl)-isocyanate, 3,3'-bitoluene-4-4'-diisocyanate, hexamethylene-diisocyanate, and naphthalene 1,5-diisocyanate; as well as other known or later developed curing agents and initiators.

Furthermore, the toner compositions of the present invention can also include release or leveling agents, such as silicones or waxes for their known effect.

In embodiments, at least one wax may be present in a toner composition in an amount of from about 1 percent by weight to about 15 percent by weight, based on the weight of the toner composition. In embodiments, the wax is present in the toner composition in an amount of from about 2 percent by weight to about 10 percent by weight, based on the weight of the toner composition, for the known effect of waxes.

Suitable waxes include, but are not limited to, low molecular weight materials, inclusive of those with a molecular weight of from about 1,000 to about 20,000; polypropylenes and polyethylenes (commercially available from Allied Chemical and Petrolite Corporation); Epolene N-15 (commercially available from Eastman Chemical Products, Inc.); Viscol 550-P, a low weight average molecular weight polypropylene (available from Sanyo Kasei K.K.); polyolefins, such as, for example, SANYO 660 P; paraffins; esters; natural waxes, such as, for example, carnauba; mixtures thereof, and the like. In embodiments of the invention, at least one wax may be present in a toner composition in an amount of from about 1 percent by weight to about 15 percent by weight, based on the weight of the toner composition. In various exemplary embodiments, the wax is present in the toner composition in an amount of from about 2 percent by weight to about 10 percent by weight, based on the weight of the toner composition, for the known effect of waxes. Particularly useful commercially available polyethylenes possess, for example, a weight average molecular weight of from about 1,000 to about 1,500, while the commercially available polypropylenes utilized are believed to have a weight average molecular weight of from about 4,000 to about 7,000. Many of the polyethylene and polypropylene compositions useful in the present invention are illustrated in British Patent 1,442,835, the entire disclosure of which is incorporated herein by reference.

Suitable silicone leveling agents include, but are not limited to, resin such as dialkyl polysiloxane with terminal functionality selected from the group consisting of amino, hydroxyl, carboxyl, carbinol, (meth)acrylate, halo alkoxy, hydride, haloalkyl, mercapto, acid anhydride, carboxyalkyl, and vinyl groups; and crosslinked polydimethylsiloxane. Commercially available silicones may possess, for example, a weight average molecular weight of from about 1,000 to about 200,000, while commercially available crosslinked siloxanes utilized are believed to have a weight average molecular weight of from about 40,000 to about 1,000,000.

In embodiments, one or more charge additive may be used in suitable effective amounts. In embodiments, the charge additive may be used in amounts from about 0.1 to about 15 percent by weight of the toner composition. In embodiments, the charge additive is used in amounts from about 1 to about 3 percent by weight of the toner composition. Suitable charge additives include, but are not limited to, alkyl pyridinium halides, bisulfates, the charge control additives of U.S. Pat. Nos. 3,944,493; 4,007,293; 4,079,014; 4,394,430 and 4,560,635 (the entire disclosures of which are hereby incorporated by reference), negative charge enhancing additives, such as, for example, aluminum complexes, and other charge additives known in the art or later discovered or developed.

In addition, in embodiments, the toner particles may be formulated in accordance with normal practice and, in particular, it is possible to prepare by the disclosed process, compositions formulated especially for corona-charging application as well as compositions formulated especially for tribo-charging application (for example, for the latter, by the use of suitable polymers of which the so-called "tribo-safe" grades are an example or by the use of additives).

The toner compositions of the present invention may also include fillers, such as, for example, quartz; silicates; aluminosilicates; corundum; ceramic fillers; glass; carbonates, such as chalk, kaolin; inorganic fibers and the like; calcium sulfate; barium sulfate; magnesium sulfate; and any other known or later developed filler materials, and are included in amounts suitable to adjust the rheological characteristics of the toner particles.

Liquid substances that can be selected for injection into the toner processing apparatus include liquids that, generally, have a boiling point lower than the melt temperature of the resin, and may optionally include additives. Accordingly, in embodiments, liquid substances with a boiling point of from about 50° F. to about 240° F., and preferably from about 80° F. to about 220° F. can be used. Where the liquid substance also comprises additives, the injected liquid substance can be comprised of any liquid or mixture of liquids that will affectively dissolve or form dispersions of the additives and that has a boiling point lower than the melt temperature of the resin. Such liquids include, for example, solvents, such as water, aliphatic alcohols, such as methanol and ethanol, and the like; and suspension mediums, which include those substances that will not affect the dissolution of the additives, for example organic solvents, such as chloroform. The optional additives that may be incorporated into the liquid substance, either in solution or in suspension, include, but are not limited to, colorants, magnetites, charge-enhancing additives, flow-control agents, plasticizers, stabilizers, antioxidants, waxes, fillers, curing agents, UV absorbing agents, light stabilizers, and the like, and mixtures thereof. Various solutions or solution mixtures of liquid substances may be injected into the toner formulation.

The liquid substances can be introduced into the toner processing apparatus at various selected suitable amounts. In embodiments, from about 1 pound to about 10 pounds of the liquid substances are injected for every 100 pounds per hour of toner formulation processed. Thus, for example, a solution mixture comprised of from about 20 percent by weight to about 30 percent by weight of charge enhancing additives may be injected into the extrusion device of FIG. 1 at an effective rate, generally of from about 1 percent of the throughput rate to about 10 percent of the throughput rate.

The toner composition prepared as described above can be formulated into a developer composition by mixing with carrier particles and/or surface additives.

In embodiments, the toner composition may incorporate, for example by dry-blending, one or more additives, such as fluidity-assisting additives, for example, those disclosed in WO 94/11446, such as aluminum oxide and aluminum hydroxide, and combinations thereof. Other dry-blended additives and surface additives that may be mentioned include curing agents; fillers such as aluminum oxide and silica, either singly or in combination; flow-promoting and flow-control agents, and charge additives, such as those described above, and combinations thereof. In addition, other additives may be included.

The toner compositions of the present invention may optionally be blended with flow-promoting and flow-control agents, such as external additive particles, which are usually present on the surface of the toner particles. Examples of these additives include, but are not limited to, metal oxides such as titanium oxide, tin oxide, mixtures thereof, and the like; colloidal silicas such as AEROSIL®; metal salts and metal salts of fatty acids including zinc stearate, aluminum oxides, cerium oxides; and mixtures thereof. These flow-aid agents are generally present in amounts of from about 0.1 percent by weight to about 10 percent by weight, and preferably in amounts of from about 0.1 percent by weight to about 5 percent by weight. Several of the aforementioned additives are illustrated in U.S. Pat. No. 3,590,000, the disclosure of which are totally incorporated herein by reference.

The total amount of dry-blended additives incorporated with the toner composition may be in the range of from 0.01 percent by weight to 10 percent by weight preferably at least 0.1 percent by weight and not exceeding 10 percent by weight (based on the total weight of the composition without the additives). However, higher or lower amounts of additives may also be used.

Surface additives also may be added to the toner composition particles in embodiments of the invention. Suitable external surface additives include, for example, metal salts, metal salts of fatty acids, colloidal silicas, titanium oxides, mixtures thereof, and the like. Such external surface additives are usually present in an amount of from about 0.1 to about 2 weight percent, as described in U.S. Pat. Nos. 3,590,000; 3,720,617; 3,655,374 and 3,983,045, the disclosures of which are totally incorporated herein by reference. These additives can be selected in amounts of, for example, from about 0.1 to about 2 percent, and which additives can be blended into the formed toner composition. The toner composition may also include known charge additives in effective amounts of, for example, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, and the like. Other known positive and negative enhancing charge additives may also be selected.

Developer compositions can be prepared by mixing the toner particles prepared by the above-described process with known carrier particles, such as steel, ferrites, and the like, as described in U.S. Pat. Nos. 4,937,166 and 4,935,326, the disclosures of which are incorporated herein in their entirety. The toner particles and carrier particles are generally mixed to form a composition including from about 2 percent toner particle concentration to about 8 percent toner particle concentration. The carriers may be coated with a single coating polymer or a mixture of polymers. The polymers that may be used for coating carrier particles include but are not limited to fluoropolymers, such as polyvinylidenefluoride resins; terpolymers of styrene; acrylate polymers; methacrylate polymers; methylmethacrylate; silane polymers, such as triethoxy silane; tetrafluoroethylenes; silicon polymers; other know coatings and the like. In addition, the polymer coating may contain conductive components, such as carbon black, in an amount of from about 2 to about 70 weight percent, preferably from about 2 to about 50 percent.

The diameter of the carrier particles is generally from about 30 microns to about 1,000 microns, thus allowing these particles to possess sufficient density and inertia to avoid adherance to the electrostatic images during the development process. The carrier particles can be mixed with the toner particles in various suitable combinations, however, best results are obtained when about 1 part per toner to about 10 parts to about 200 parts by weight of carrier are mixed.

In addition, embodiments of the present invention include imaging methods that utilize toner particles prepared by the above-described method. Suitable imaging methods are known in the art and include, but are not limited to, electrophotographic and electrostatographic imaging methods.

EXAMPLES

Example 1

A mixture comprising 90% resin, 5% polyolefin wax and 5% carbon black was melt-mixed in a Werner and Pleiderer ZSK-25 Extruder, which was operated under the following conditions: throughput rate of 70 pounds per hour, screw speed of 500 revolutions per minute, and barrel temperature of 140° C. Water was injected into the mixing chamber at a rate equal to 2.5% of the throughput rate.

Vacuum was applied to remove water vapor from the mixture for a portion of the extrusion time. For the remainder of the extrusion time, no vacuum was applied.

The extrudate was cooled and pelletized. The pellets were micronized, using a model 0202-2 grinder (available from Fluid Energy Processing and Equipment Company) to form toner particles. The rate of micronization of the toner formed from the extrudate prepared without vacuum removal of water vapor was about 6.8% faster than the rate of micronization of the toner formed from the extrudate prepared using vacuum removal of water vapor.

Example 2

A mixture comprising 90% resin, 5% polyolefin wax and 5% carbon black was melt-mixed in a Werner and Pleiderer ZSK-25 Extruder, which was operated under the following conditions: throughput rate of 70 pounds per hour, screw speed of 500 revolutions per minute, and barrel temperature of 130° C. Water was injected into the mixing chamber at a rate equal to 5% of the throughput rate.

Vacuum was applied to remove water vapor from the mixture for a portion of the extrusion time. For the remainder of the extrusion time, no vacuum was applied.

The extrudate was cooled and pelletized. The pellets were micronized, using a model 0202-2 grinder (available from Fluid Energy Processing and Equipment Company) to form toner particles. The rate of micronization of the toner formed from the extrudate prepared without vacuum removal of water vapor was about 36% faster than the rate of micronization of the toner formed from the extrudate prepared using vacuum removal of water vapor.

Although the invention has been described with reference to specific preferred embodiments, it is not intended to be limited thereto, rather those skilled in the art will recognize that variations and modifications may be made therein which are within the spirit of the present invention and within the scope of the following claims.

What is claimed is:

1. A method for the preparation of toner particles with a mixture of resin particles and additive particles, comprising (1) providing a toner processing apparatus;

(2) adding resin particles and additive particles to the toner processing apparatus;

(3) blending the resin particles and the additive particles in a blending chamber to form an extrudate, wherein the blending chamber is maintained at a temperature of from about 50° C. to about 230° C.;

(4) extruding the extrudate to form extruded material; and (5) grinding the extruded material to form toner particles;

wherein a liquid substance comprising an aliphatic alcohol is injected into the blending chamber during the extruding, the liquid substance having a lower boiling point than the temperature of the resin particles; and wherein the liquid substance is not removed from the blending chamber by vacuum extraction; and wherein the liquid substance may be injected into the blending chamber at any specified point during extrusion.

2. The method according to claim 1, wherein the resin particles are selected from the group consisting of thermoplastic resins, thermoset resins and curable resins.

3. The method according to claim 1, wherein the resin particles are selected from the group consisting of polyesters, styrene-n-butyl methacrylate copolymers, styrene butadiene copolymers and mixtures thereof.

4. The method according to claim 1, wherein the additive particles are selected from the group consisting of colorants, magnetites, charge-enhancing additives, flow-control agents, plasticizers, stabilizers, antioxidants, waxes, fillers, curing agents, UV absorbing agents, light stabilizers, and mixtures thereof.

5. The method according to claim 1, wherein the additive particles are selected from the group consisting of polyolefins, paraffins, esters and natural waxes.

6. The method according to claim 1, wherein the liquid substance further comprises an additive.

7. The method according to claim 6, wherein the additive is selected from the group consisting of colorants, magnetites, charge-enhancing additives, flow-control agents, plasticizers, stabilizers, antioxidants, waxes, fillers, curing agents, UV absorbing agents, light stabilizers, and mixtures thereof.

* * * * *